United States Patent [19]

Ludwig et al.

[11] 4,436,185

[45] Mar. 13, 1984

[54] ELEVATOR SYSTEM

[75] Inventors: Richard H. Ludwig, West Caldwell; Wing C. Quan, Waldwick; Alan L. Husson, Hackettstown; Linus R. Dirnberger, Randolph; Marjorie J. Polis, Morris Township, Morris County, all of N.J.

[73] Assignee: Westinghouse Electric Corp., Pittsburgh, Pa.

[21] Appl. No.: 370,021

[22] Filed: Apr. 20, 1982

[51] Int. Cl.[3] ..... B66B 3/02

[52] U.S. Cl. ..... 187/29 R; 340/21

[58] Field of Search ..... 187/29; 340/19, 21

[56] References Cited

U.S. PATENT DOCUMENTS

| | | | |
|---|---|---|---|
| 3,720,292 | 3/1973 | Magee | 187/29 |
| 4,124,103 | 11/1978 | Otto et al. | 187/29 |
| 4,134,476 | 1/1979 | Zolnerovich, Jr. et al. | 187/29 |
| 4,220,222 | 9/1980 | Kamaike et al. | 187/29 |
| 4,368,518 | 1/1983 | Terazono et al. | 187/29 X |

*Primary Examiner*—J. V. Truhe
*Assistant Examiner*—W. E. Duncanson, Jr.
*Attorney, Agent, or Firm*—D. R. Lackey

[57] ABSTRACT

A method of reinitializing an elevator system upon the return to service of an elevator car following the occurrence of an event which could result in the car stopping in the hatch without regard to floor level. The method includes the steps of determining if the elevator car is within a predetermined small distance from any floor, and if it is, the advanced car position is set to that floor. If the elevator car is not within this predetermined distance from a floor, the advanced car position is set to the closest floor in a predetermined travel direction, such as the travel direction of the car at the time of the event which terminated normal operation. The car is then moved to a predetermined floor, which is the floor of the advanced car position when there are no registered hall calls, and the floor of a predetermined car call, or hall call, where there is a registered call.

13 Claims, 8 Drawing Figures

ELEVATOR SYSTEM

BACKGROUND OF THE INVENTION

1. Field of the Invention

The invention relates in general to elevator systems, and more specifically to new and improved methods of reinitializing an elevator system following an occurrence which may stop an elevator car without regard to floor level.

2. Description of the Prior Art

The controls of elevator systems attempt to stop an elevator car at floor level in response to an event which requires that the elevator service by a specific car, or all cars of the system, be terminated for some reason. It is a simple matter to reinitialize the controls of the elevator cars when they are returned to service, if they are located at floor level.

Certain events, however, can terminate elevator service and stop an elevator car without regard to its position relative to a floor. For example, the operation of the emergency stop button in the car, or loss of electrical power, will stop a moving elevator car without regard to its position relative to a floor. Reinitializing the elevator system when power returns, or the emergency stop button is returned to its normal position, or any other occurrence which can trigger an emergency stop is corrected, necessarily involves locating the position of the car in the hatch. Some prior art elevator systems return the car to a predetermined floor, such as the lower terminal floor, to reset and synchronize the floor selector with car position.

SUMMARY OF THE INVENTION

Briefly, the present invention is a new and improved method of reinitializing an elevator system when it returns to service following an occurrence in which an elevator car can stop in the hatch without regard to floor level. This type of occurrence will be referred to hereinafter as an emergency stop. The invention relates to an elevator system which is of the type where the hatch position of the car will usually be known, to some small increment, even after a power outage, such as by incremental counting in response to car movement. Battery back-up may be used, for example, to maintain the floor position counter, in the event the counter is of the volatile type. The elevator system will also be of the type in which the position of each floor, in terms of the car position count, is also known, and stored in a suitable memory.

The new and improved method of the invention resets the advanced car position of the car being reinitialized. The new and improved method also moves the elevator car, when it is not at a floor level at the time of reinitialization. The floor to which the car is moved depends upon system conditions, with the car being moved to a floor associated with a car call, or a hall call, when there are car or hall calls in the system, and otherwise being moved to the floor of its advanced car position. The advanced car position is defined as the floor at which a stationary car is located, or the floor at which a moving elevator car can make a normal stop according to a predetermined deceleration schedule.

More specifically, the new and improved method includes the steps of determining if a car being reinitialized is within a predetermined distance from a floor. In a preferred embodiment, the lower and upper terminal floors are checked first, and then the intermediate floors. The predetermined distance, for example, may be the leveling distance, which defines the leveling zone adjacent to each floor level, which may be in the range of about ±2 to 4 inches, with reference to floor level. If the elevator car is within this predetermined distance from a floor, the advanced car position AVP is set to this floor. If the car is not within this predetermined distance from a floor, the AVP is set to the closest floor to the car in a predetermined direction. The predetermined direction is preferably the travel direction of the elevator car at the time of the emergency stop. The predetermined floor to which the car is moved is the assigned AVP floor, if there are no registered calls for elevator service. This may be accomplished by assigning the car to a dummy call for this floor.

If there is a registered car call for a floor ahead, or a registered hall call from a floor ahead of the elevator car in the last travel direction, the predetermined floor to which the car is moved is the closest such floor. If there is no car or hall call associated with a floor ahead of the car in the last travel direction, but there is a registered car or hall call associated with a floor in the opposite travel direction, the AVP is set to the closest of such floors in the opposite travel direction, and the predetermined floor to which the car is moved is the floor associated with the closest of such calls to the car. This is accomplished by assigning the car to this "closest" floor. This method thus reduces the time required to get an elevator car back into service and serving calls for elevator service.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

The invention is a new and improved method of reinitializing an elevator system upon the return to service of a car, or cars, where service was abruptly terminated in a manner which allows the cars to stop without regard to floor level. The method substantially reduces the time required for the elevator system to start serving calls for elevator service, compared, for example, with methods which send each elevator car to a predetermined terminal floor for resetting. The type of elevator system to which the invention is directed is one in which the position of each elevator car will normally be known at the time of reinitialization, with the method being directed to setting the advanced car position of each elevator car in a manner which results in the fastest return to effective service for the associated building.

The new and improved method is described by illustrating only those parts of an elevator system pertinent to the understanding of the new and improved method, with the remaining portions of a complete elevator system being incorporated by reference to issued patents assigned to the same assignee as the present application. Accordingly, U.S. Pat. Nos. 3,750,850; 3,804,209; 4,240,527; 3,902,572; and 5,019,606, are incorporated into the specification of the present application by reference. U.S. Pat. No. 3,750,850 sets forth a car controller, including a floor selector and speed pattern generator, U.S. Pat. No. 3,804,209 describes an interfacing arrangement for controlling and making assignments to a plurality of elevator cars under group supervisory control, which have the car controllers of U.S. Pat. No. 3,750,850, and U.S. Pat. No. 4,240,527 sets forth call answering strategy as well as computer control with a bidding arrangement for subprogram selection. U.S. Pat. Nos. 3,902,572 and 4,019,606 illustrate cam switch, and optoelectronic arrangements, respectively, which may be used to detect when an elevator car is within a predetermined distance from a floor.

Figure 1:
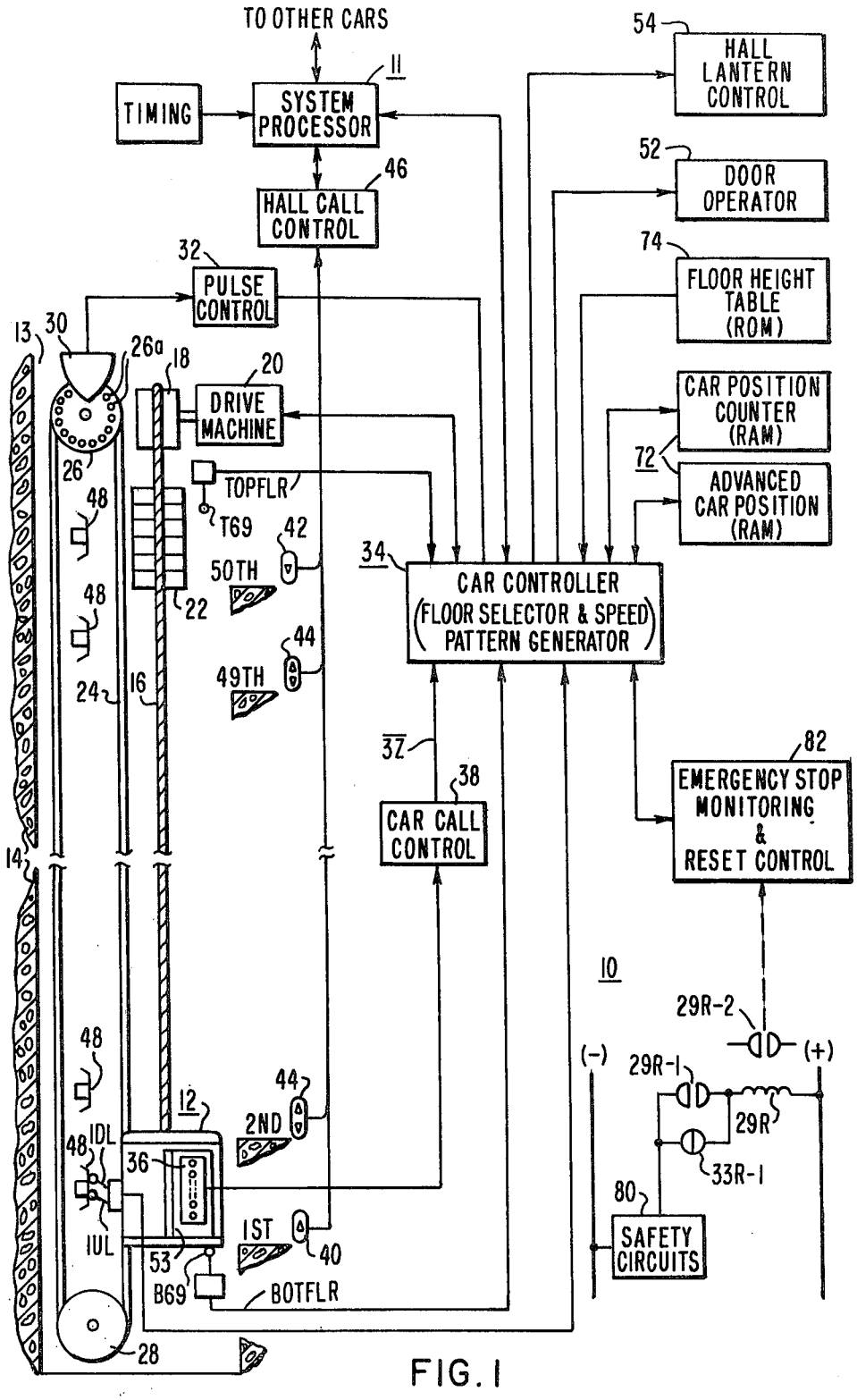
FIG. 1 is a schematic diagram of an elevator system which may be operated according to the reinitialization methods of the invention.

More specifically, FIG. 1 illustrates an elevator system 10 which may utilize the teachings of the invention. Elevator system 10 includes one or more elevator cars, such as elevator car 12, the movement of which is controlled by a car controller 34, which in turn may be controlled by a system processor 11, when the system is under group supervisory control. The car controller 34 includes a floor selector and speed pattern generator, which are described in detail in incorporated patent 3,750,850. When the elevator cars are under group supervisory control, the car controller 34 of each car receives assignments from the system processor 11, as set forth in detail in incorporated Patents 3,804,209 and 4,240,527. Since each of the cars of the bank of cars, and the controls therefore, are similar in construction and operation, only the controls for car 12 will be described in detail. Car 12 is mounted in a hatchway 13 for movement relative to a structure 14 having a plurality of landings, such as 50, with only the 1st, 2nd, 49th and 50th floors or landings being shown, in order to simplify the drawing. The car 12 is supported by a plurality of wire ropes 16 which are reeved over a traction sheave 18 mounted on the shaft of a drive machine 20. The drive machine 20 may be an AC system having an AC drive motor, or a DC system having a DC drive motor, such as used in the Ward-Leonard drive system, or in a solid state drive system. A counterweight 22 is connected to the other ends of the ropes 16. A governor rope 24, which is connected to the car 12, is reeved over a governor sheave 26 located above the highest point of travel of the car in the hatchway 13, and over a pulley 28 located at the bottom of the hatchway. A pick-up 30 is disposed to detect movement of the elevator car 12 through the effect of circumferentially spaced openings **26*a* in the governor sheave 26, or in a separate pulse wheel which is rotated in response to rotation of the governor sheave. The openings 26*a* are spaced to provide a pulse for each standard increment of travel of the car, such as a pulse for each 0.25 inch of car travel. Pick-up 30 may be of any suitable type, such as optical or magnetic. Pick-up 30 is connected to pulse control 32 which provides distance pulses for the car controller 34. Distances pulses may be developed in any other suitable manner, such as by a pick-up disposed on the elevator car 12** which cooperates with a coded tape disposed in the hatchway, or other regularly spaced indicia in the hatchway.

Car calls, as registered by pushbutton array 36 mounted in the car 12, are processed by car call control 38, and the resulting information, in the form of a signal $\overline{3Z}$ is directed to the car controller 34.

Hall calls, as registered by pushbuttons mounted in the hallways, such as the up pushbutton 40 located at the first floor, the down pushbutton 42 located at the 50th floor, and the up and down pushbuttons 44 located at the second and other intermediate floors, are processed in hall call control 46. The resulting processed up and down hall call information in the form of signals $\overline{UPC}$ and $\overline{DNC}$, respectively, is directed to the system processor 11. The system processor 11 directs the hall calls to the cars according to a predetermined strategy, to effect efficient service for the various floors of the building and effective use of the cars. When the system processor 11 is not operational, the hall calls are directed to the car controllers of all of the cars.

The car controller 34 processes the distance pulses from the pulse detector 32 to develop information concerning the position of the car in the hatchway 13, to the resolution of the standard increment. The distance pulses are also utilized by the speed pattern generator, to generate a speed reference signal for the drive machine 20.

The car controller 34 through its floor selector keeps track of the position of the car 12, and the calls for service for the car. It also provides the signals for starting and stopping the elevator car to serve calls for elevator service. The car controller 34 also provides signals for controlling such auxiliary devices as the door operator 52, which controls the door 53 on the car 12, the hall lantern 54, and it controls the resetting of the car call and hall call controls when a car or hall call has been serviced.

Landing and leveling of the car 12 at each floor may be accomplished by leveling switches 1DL and 1UL on the car, which cooperate with leveling cams 48 at each floor, as described in detail in incorporated U.S. Pat. No. 3,902,572; or by a hatch transducer system which utilizes inductor plates disposed at each landing, and a transformer disposed on the car 12.

Figure 2:
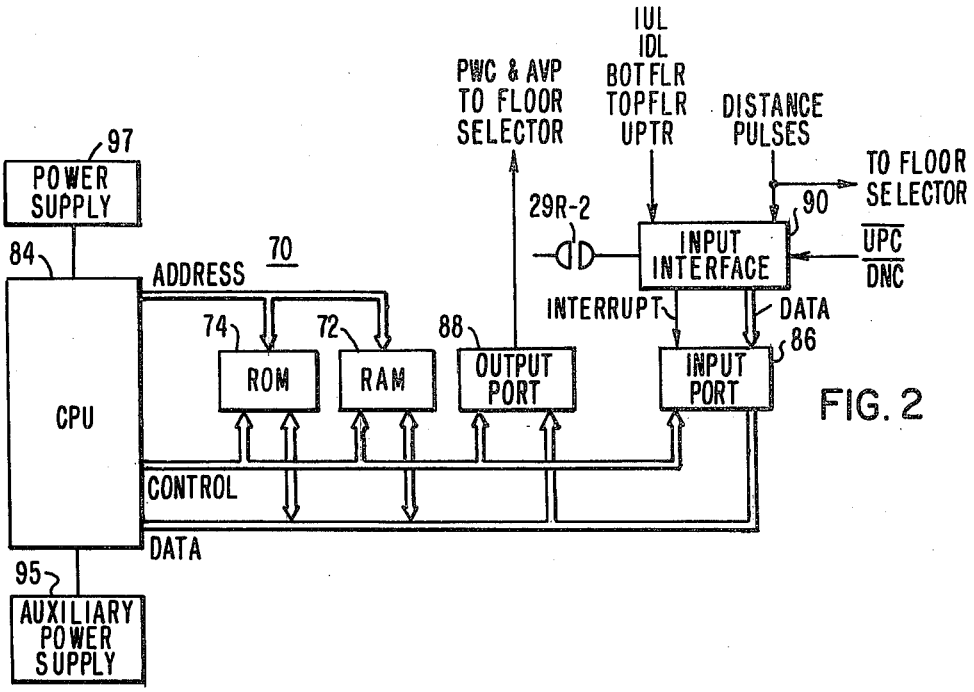
FIG. 2 illustrates a microprocessor which may be part of the car controller shown in FIG. 1.
Figure 3:
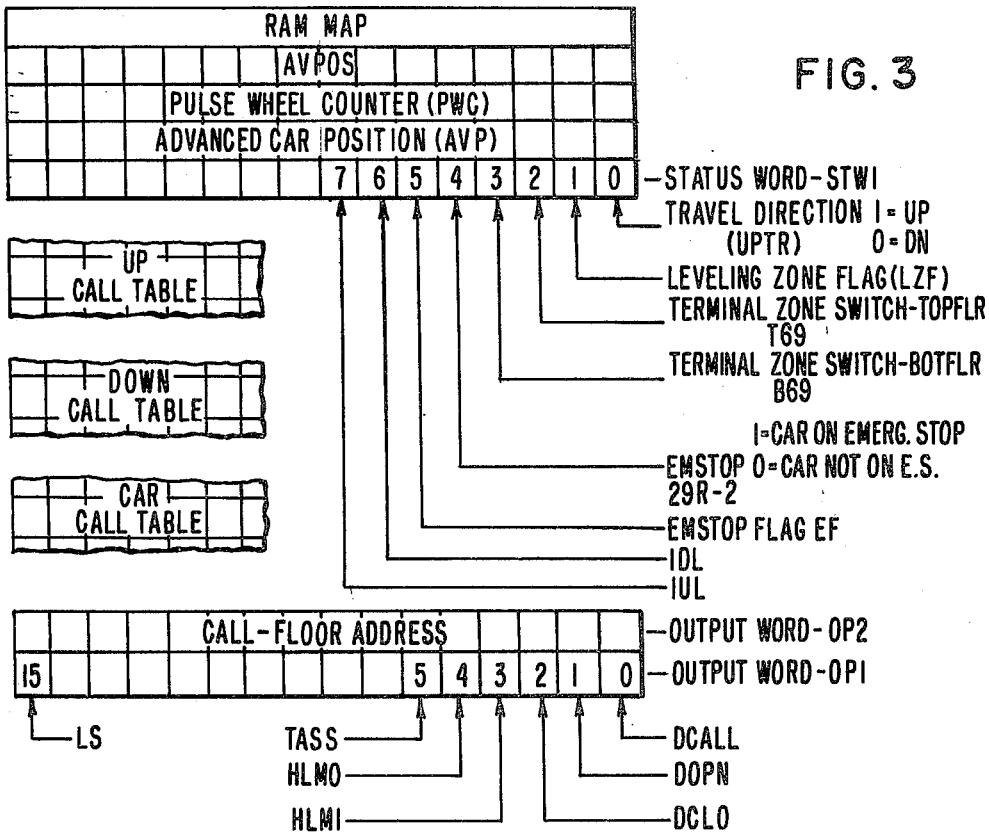
FIG. 3 is a RAM map illustrating the storage of the car position count, the advanced car position count, and the status of certain other car, system and program related signals and flags.

The actual car position may be maintained by a solid state, binary up/down counter, and/or the car controller 34 may include a digital computer, such as a microprocessor 70, shown in FIG. 2. The microprocessor 70 may maintain a counter in RAM 72, for maintaining the car position, which counter will be referred to as pulse wheel counter PWC. FIG. 3 is a RAM map which sets forth suitable formats for certain data which may be stored in RAM 72, including the pulse wheel counter PWC. PWC may be auxiliary to a counter in the floor selector of the car controller, or, if the functions of the car controller are all implemented by a microprocessor, PWC may be the primary car position counter.

Each floor of the building has a binary address corresponding to its height or distance from the lowest floor of the building, with the binary address being in the terms of the standard increment. The first floor address may be all zeros. If the 50th floor is 600 feet above the first floor, its binary address, when a pulse is generated for each 0.25 inch of car travel, would be 0111 0000 1000 0000, the binary representation for 28,800. The binary address for each floor is maintained in a floor height table stored in ROM 74, with FIG. 4 being a ROM map which sets forth a suitable format for the floor height table. The floor height table in ROM 74 may be the same one used by the floor selector of the car controller 34 in formulating its decisions, such as deceleration signals, for stopping the elevator car at the proper floor, or it may be auxiliary to another floor height table, as desired.

When elevator car 12 is located within a predetermined distance from the lower terminal or first floor, its presence is physically detected by a switch B69, which provides a true signal BOTFLR when actuated. In like manner, when elevator car 12 is located within a predetermined distance from the upper terminal or 50th floor, its presence is physically detected by a switch T69, which provides a true signal TOPFLR when actuated. Thus, switches B69 and T69 indicate when the elevator car 12 is in a terminal zone.

Each elevator car of the elevator system 10 includes a safety relay 29R, as shown in FIG. 1. If the serial string of contacts which make up the safety circuits 80 are all closed, and the elevator car is stopped, a running relay 33R will be dropped out and a n.c. contact 33R-1 of this relay will be closed. This situation causes the safety relay 29R to pick up and seal in via its n.o. contact 29R-1. When relay 29R is picked up, the associated elevator car 12 is allowed to run. When any contact in the serial string of contacts of the safety circuits 80 opens, relay 29R drops out and the elevator car stops without regard to its position relative to a floor level. This is referred to as an emergency stop, which is accomplished by removing the voltage from the drive motor of the drive machine 20, and by setting the friction brake of the drive machine 20. Certain of the contacts and the safety circuits 80 will not reclose after they once open, requiring maintenance personnel to investigate the cause of the emergency stop before placing the elevator car back into service. Other contacts, such as the emergency stop button located in the elevator car, may be reclosed after opening, which will allow relay 29R to pick up, after the elevator car comes to a complete stop, and the elevator car will be placed back into service after reinitialization. The return of power after a power outage, also allows relay 29R to pick up with the return of power, if the elevator car is stationary at this point. The present invention is a new and improved method of reinitializing the elevator system when relay 29R picks up following an emergency stop. Emergency stop monitoring and reset control 82, shown in FIG. 1, is responsive to the condition of a contact 29R-2 of the safety relay 29R. Control 82 is incorporated into the microprocessor 70, shown in FIG. 2, and is implemented by the programs set forth in detail in FIGS. 5, 6, 7 and 8.

Referring now to FIG. 2, microprocessor 70 includes a central processing unit or CPU84, an input port 86, an output port 88, and the memories 72 and 74, which were hereinbefore referred to. An input interface 90, which may include a scratchpad memory, receives the distance pulses from the pulse control 32, the travel direction signal UPTR, which is a logic one when the elevator car is set for up travel, and a logic zero when tne car is set for down travel, and it also receives a signal responsive to the condition of contact 29R-2 of the safety relay 29R. Microprocessor 70 may have access to the hall call cable of the car controller 34, or it may sample the serial up and down hall call signals $\overline{UPC}$ and $\overline{DNC}$ prepared by the car controller 34, at the time it is necessary to check for hall calls, as will be hereinafter explained. Microprocessor 70 also receives signals BOTFLR and TOPFLR, which, when a logic one, indicate the elevator car is located within the lower and upper terminal zones, respectively. Microprocessor 70 also receives signals from switches 1DL and 1UL, which indicate when the elevator car 12 is located in a leveling zone adjacent to a floor level. As shown in the RAM map of FIG. 3, the travel direction may be stored at bit position zero of a 16 bit status word STW1. Bit positions 2 and 3 store the signals TOPFLR and BOTFLR, respectively. Bit position 4 stores the condition of contact 29R-2, which signal is referred to as EMSTOP. When contact 29R-2 is closed, EMSTOP is a logic zero, indicating the car is not on an emergency stop, and when contact 29R-2 is open, EMSTOP is a logic one, indicating the elevator car is on emergency stop. Bit positions 6 and 7 store the conditions of leveling switches 1DL and 1UL. A logic zero indicates the corresponding leveling switches not actuated, and a logic one indicates the switch is actuated. When either leveling switch is actuated, the elevator car is in a leveling zone.

Bit positions 1 and 5 of status word STW1 are used by the program to store a leveling zone flag LZF and an EMSTOP flag EF, respectively, the purposes of which will be hereinafter explained. RAM 72 may also store a hall call table, as shown in FIG. 3, indicating registered hall calls. This table may be created from signals $\overline{UPC}$ and $\overline{DNC}$. RAM 72 also stores the advanced car position AVP, prepared by the emergency stop and reset control 82, as will be hereinafter explained, and a temporary word AVPOS, used by the reinitialization program.

Figure 5:
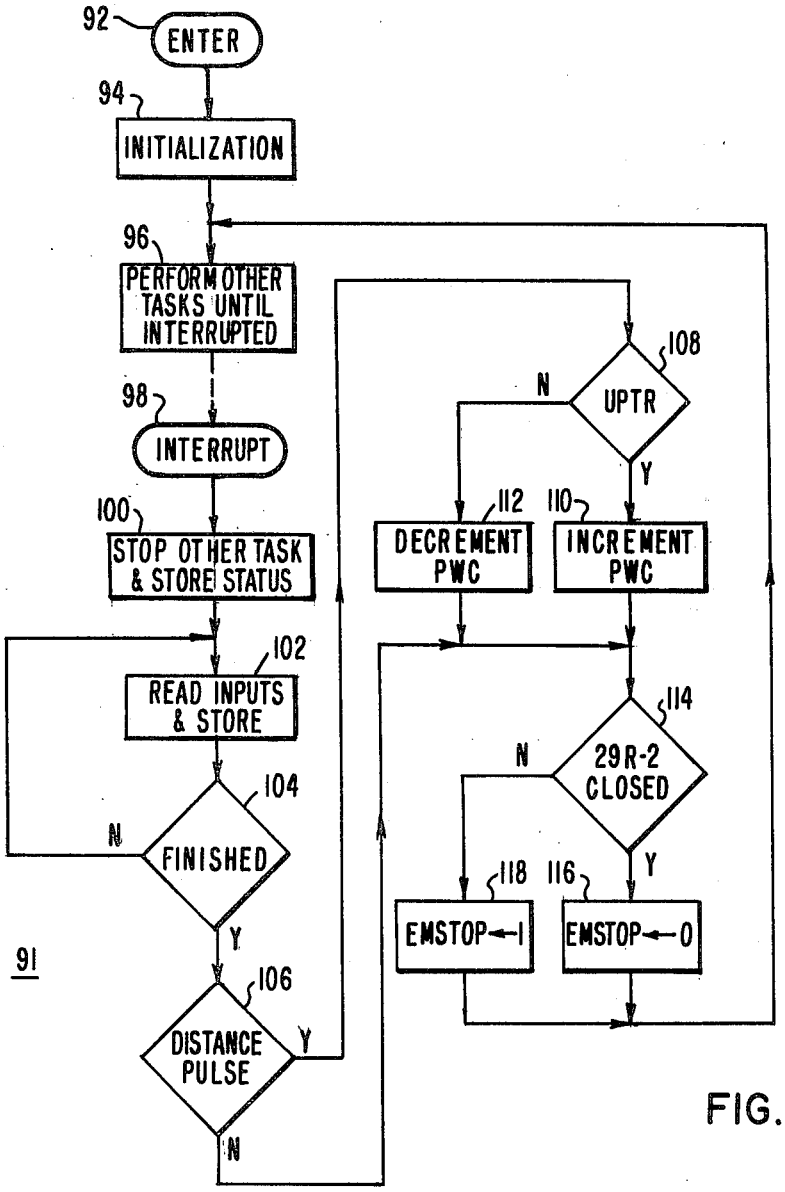
FIG. 5 is a flow chart of the program which may be run by the microprocessor shown in FIG. 2.

FIG. 5 is a flowchart of a program 91 which may be stored in ROM 74 and run by CPU 84. Program 91 is entered at 92 and it is initialized at 94 upon application of power when the elevator car 12 is to be started. The initialization step, for example, resets program flags LZF and EF, and clears temporary word locations. The information and RAM 72 is maintained, even during shutdown of the elevator car 12, by a suitable battery or auxiliary power supply 95, which supplies power to certain circuits of the microprocessor 70 when the main power supply 97 is turned off, or interrupted. If the elevator car 12 is located at the lower terminal floor during the initialization step, signal BOTFLR will be true, and step 94 will also zero the pulse wheel counter PWC. Step 96 then goes on to perform other tasks, until the input interface 91 shown in FIG. 2 generates an interrupt signal. An interrupt will be generated when each distance pulse is received, and it may also be set to generate an interrupt upon each change in the condition of contact 29R-2.

When an interrupt is generated, indicated by interrupt line 98 in FIG. 2, step 100 stops the task it is processing and stores its status for later return, and step 102 reads the inputs applied to input port 86 by interface 90. If all inputs cannot be transferred at one time, step 104 checks to determine if all of the information has been transferred, and if not, the program returns to step 102 to transfer the next batch of data. When step 104 finds all data has been read and stored, step 106 determines if the interrupt was due to a distance pulse. If it was, step 108 checks bit position zero of the status word in RAM 72 to determine car travel direction. If it is up, step 110 increments the pulse wheel counter PWC. If it is down, step 112 decrements PWC.

Steps 110 and 112 both advance to step 114, as does step 106 when the interrupt was not created by a distance pulse. Step 114 checks the status of contact 29R-2. Step 116 sets EMSTOP, bit 4 of STW1, to a logic zero, if contact 29R-2 is closed, and step 118 sets it to a logic one when contact 29R-2 is open. The program then returns to step 96.

Figure 6:
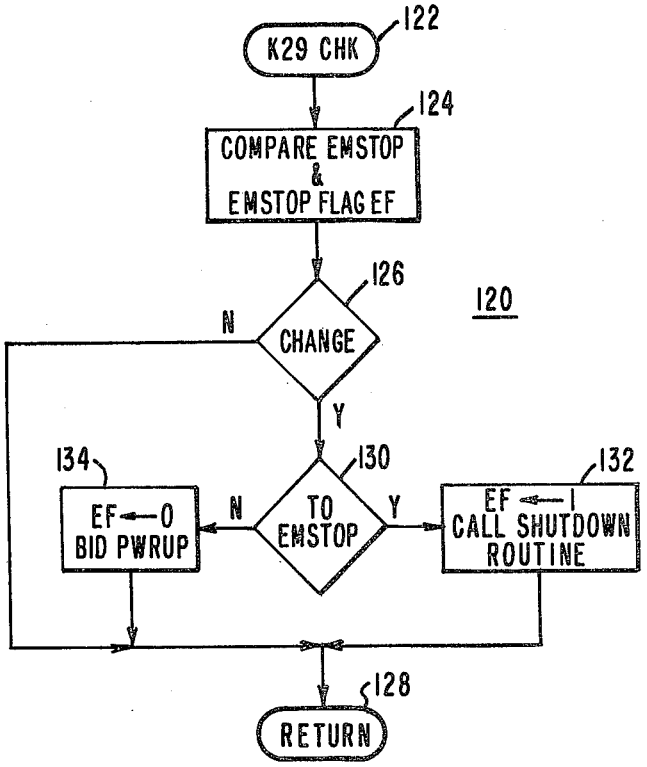
FIG. 6 is a flow chart of a subprogram which may be periodically run to check for an emergency stop, and a return to service following an emergency stop.

FIG. 6 is a flow chart of a subprogram 120 which may be periodically placed in bid and run as one of the tasks indicated at step 96 of FIG. 5. This subprogram looks for a change in the condition of the safety relay 29R. When the elevator system 10 is initialized in step 94, flag EF will be reset to zero at bit 5 of STW1, and program 91 will set bit 4 to a logic zero in step 116, because relay 29R will pick up and close contact 29R-2. Thus, program 120, which is entered at 122, compares bits 4 and 5. If they are both the same, i.e., both logic zero, there has been no change and the subprogram 120 returns to the main program at 128. Thus, step 126 exclusive OR's bits 4 and 5, advancing to the return point 128 when the result is a logic zero.

If relay 29R should drop and cause an emergency stop condition, EMSTOP, bit 4 of the status word STW1, will be changed to a logic one by program 91 at step 118. The next time subprogram 120 is run, an exclusive OR of bits 4 and 5 by step 126 will result in a logic one, and the program will then branch to step 130 to see if the change was due to the system going on emergency stop, or coming off of an emergency stop. If the system just went on an emergency stop, bits 4 and 5 will be 1-0, respectively, and if the system is just returning to service following an emergency stop, bits 4 and 5 will be 0-1, respectively. If the bits 4 and 5 are 1-0, respectively, the system just went on an emergency stop and step 130 goes to step 132 which sets flag EF to a logic one. Step 132 may also call a shut-down routine, if it is necessary to transfer information from volatile memories to memories which will be kept alive during the emergency stop. The set program then returns to program 91. The next time subprogram 120 is run, step 126 will find bits 4 and 5 to be 1-1, and it will continue to find this until the system returns from the emergency stop and relay 29R picks up to close its contact 29R-2. Step 116 of program 91 will zero bit 4 of STW1 when relay 29R picks up. The next time program 120 runs, step 126 will find bits 4 and 5 of STW1 to be 0-1, respectively, and step 130 will branch to step 134. Step 134 zeros flag EF, which is bit 5 of STW1, and it places a routine PWRUP into bit. The next time subprogram 120 is run, step 126 will find bits 4 and 5 of STW1 to be 0-0.

Figure 4:
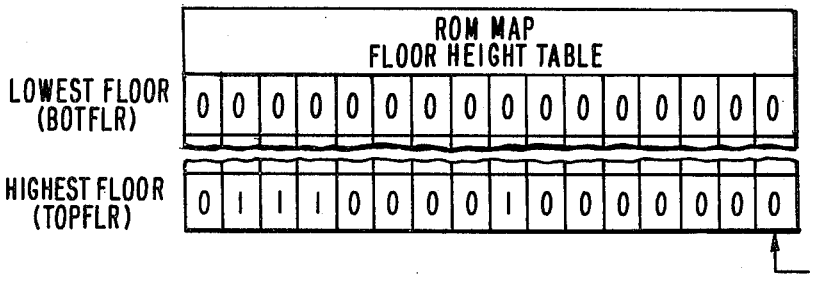
FIG. 4 is a ROM map illustrating a floor height table which provides the floor height address for each floor of the building.
Figure 7:
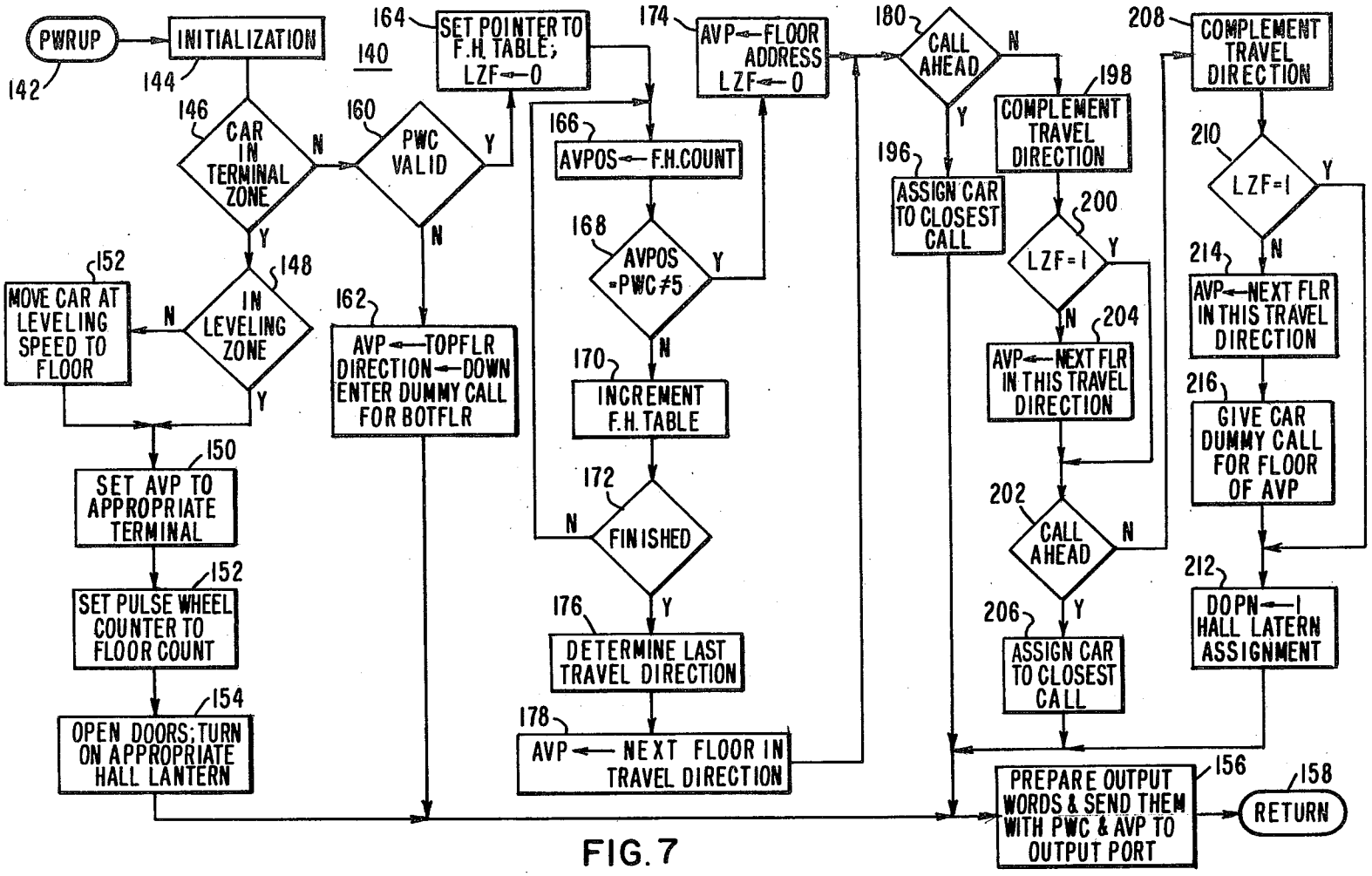
FIG. 7 is a flow chart of a subprogram which may be placed into bid by the subprogram shown in FIG. 4, when the elevator system is being reinitialized following an emergency stop.

FIG. 7 is a flow chart of a subprogram 140, which is the routine PWRUP placed into bid by step 134 of subprogram 120. Subprogram 140 is entered at 142, and, if information stored in non-volatile memories must be reloaded into volatile memories, step 144 performs this initialization function. The subprogram 140 first checks to see if the elevator car is located in a terminal zone, as defined by the terminal zone switches B69 and T69. This is determined by checking bits 2 and 3 of STW1. If the car is located in a terminal zone, which may be a six inch zone, for example, step 148 checks to see if the car is in the leveling zone, which may be a smaller zone, such as 2 to 3 inches, for example. Step 148 may check bits 6 and 7 of the status word STW1 to determine if either 1DL or 1UL is actuated. If either is actuated, the car is located in the leveling zone, and step 150 sets the advanced car position AVP to the address of the appropriate terminal floor, which addresses are shown in FIG. 4. The advanced car position AVP is shown in the RAM map of FIG. 3. If the elevator car is in a terminal zone, but not in the leveling zone, step 152 moves the car to floor level at leveling speed. As shown in FIG. 3, this may be accomplished by setting a leveling speed bit LS to a logic one (bit 15 of output word OP1), and the travel assignment bit TASS (bit 5 of output word OP1) to the appropriate travel direction (one equals up; zero equals down). Step 150 sets the advanced car position AVP to the appropriate terminal address, and step 152 sets the pulse wheel count PWC to the address of this terminal. Step 154 prepares the command DOPN to open the car doors by setting bit position one of output word OP1 to a logic one, and it prepares the command for lighting the appropriate hall lantern. Signals HLM0 and HLM1 located in bit positions 4 and 3, respectively, of OP1, control the hall lanterns, as described in incorporated U.S. Pat. No. 3,804,209. Step 156 prepares the output words OP1 and OP2, and sends them, along with the words PWC and AVP to output port 88 for transmission to the car controller 34.

If step 146 does not find the elevator car to be located in a terminal zone, step 160 checks the pulse wheel counter PWC to see if the count is valid. If the count is all zeros, it is not valid, as step 146 found that the elevator car was not located at the lower terminal floor. If the count is not all zeros, it is presumed valid. If step 160 finds the count is not valid, step 162 sends the elevator car to a predetermined floor for resetting. Normally, this predetermined floor is the lower terminal floor, with the car stopping at this floor because terminal slow-down controls will automatically decelerate and stop an elevator car at the terminal floors. Terminal slow-down controls for performing this function are described in incorporated Patent 3,750,850. Step 162 implements this function by setting AVP to the address of some floor other than the lower terminal floor, such as to the address of the upper terminal floor, by setting bit 5, the travel direction assignment TASS of OP1 to zero, by setting bit zero of OP1 to 1, which places a dummy call DCALL, and by zeroing output word OP2, which is the floor address of the dummy call. Thus, the elevator car will travel downwardly and the AVP will never match the address of a floor, and thus the car will stop at the lower terminal floor, where PWC and AVP will both be zeroed, to resynchronize the floor selector of the car controller 34.

If step 160 finds the counter of PWC to be valid, the program advances to step 164. Step 164 starts a portion of the program which determines the advanced car position AVP. It first determines if the car is in the leveling zone of an intermediate floor, and if so, it sets the AVP to this floor. If it is not within the leveling zone of an intermediate floor, it sets the AVP to the nearest floor in the last travel direction. The determination of whether the elevator car is in the leveling zone of a floor may be determined by checking bits 6 and 7 of the status word STW1. If either 1DL or 1UL is found to be actuated, the program would then determine the associated floor. This determination may also be made as shown in FIG. 7, starting at step 164, which sets a pointer to the lowest floor of the floor height table shown in the ROM map of FIG. 4. The leveling zone flag LZF, bit position 1 of STW1, is also reset, i.e., zeroed. Step 166 stores the floor height or address pointed to by the stack pointer in the temporary word location AVPOS shown in FIG. 3, which at this point is the address of the lowest floor. Step 168 then compares AVPOS with the pulse wheel count PWC to see if the counts are close enough to place the car in the leveling zone of this floor. If the leveling zone is a total of 2.5 inches, for example, then AVPOS and PWC would be compared to see if their counts are within ±5. If they are not within ±5 counts of one another, step 170 increments the pointer and step 172 checks to see if all floors have been considered. If not, the program returns to step 166, which loads the address of the next floor into the temporary location AVPOS.

If step 168 finds the elevator car in a leveling zone, step 174 sets AVP to the address of this floor, and it also sets the leveling zone flag LZF to a one, to indicate that the elevator car is in the leveling zone of an intermediate floor. Step 174 then advances to step 180.

If step 172 finds all floors to be considered, and the elevator car has not been found to be in the leveling zone of any floor, step 176 checks bit zero of STW1 to determine the last travel direction of the elevator car. Step 178 then sets AVP to the address of the closest floor in this travel direction.

Figure 8:
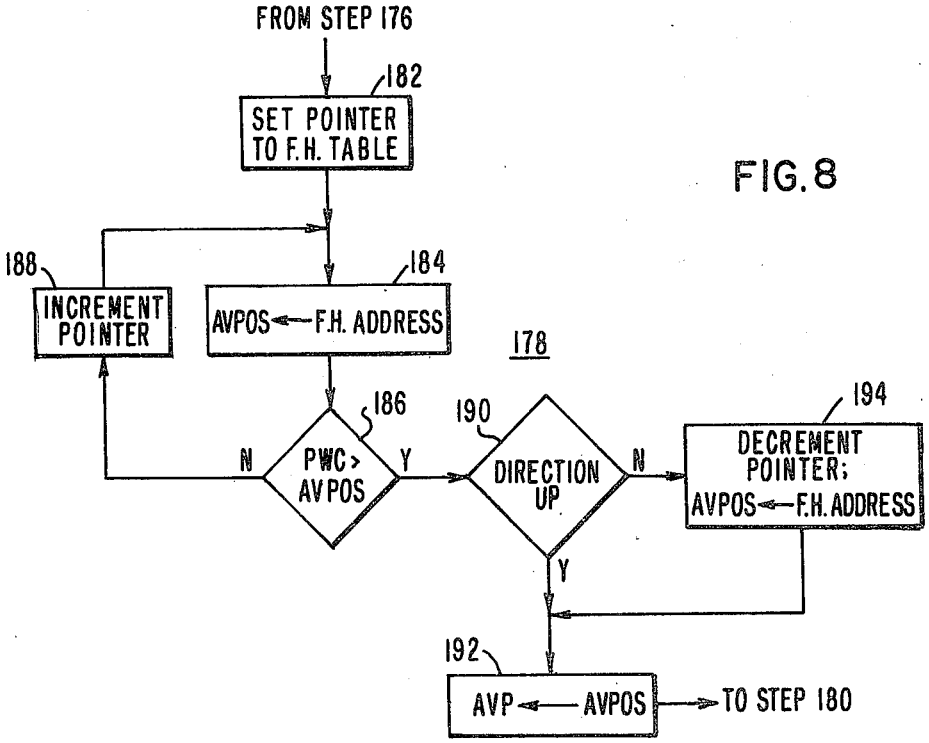
FIG. 8 is a subroutine which is called by the subprogram shown in FIG. 7 when the closest floor to the car location in a predetermined direction is to be determined.

FIG. 8 is subroutine which may be called by step 178, or substituted for step 178, as desired, to determine the closest floor to the elevator car in its last-travel direction. Step 182 sets a pointer to the address of the lowest floor in the floor height table shown in FIG. 4, and the floor address pointed to is loaded into the temporary word position AVPOS in FIG. 3. Step 186 checks to see if PWC is greater than AVPOS. If it is, the car is above this floor, and step 188 increments the floor height table pointer. Step 184 loads the new address into AVPOS. This process is repeated until step 186 finds that PWC no longer exceeds AVPOS, and thus the floor address in AVPOS is the address of the floor located immediately above the elevator car. Step 190 then checks bit zero of STW1 for the last travel direction. If it was up, the contents of AVPOS already contains the closest floor to the elevator car in the up travel direction, and step 192 loads AVPOS into AVP. If the last travel direction was down, step 190 goes to step 194 which decrements the stack pointer and loads the floor height address pointed to into AVPOS. AVPOS now contains the address of the closest floor ahead of the car in the downward travel direction, and step 192 loads AVPOS into AVP.

Steps 174 and 178 both advance to a portion of the program which determines where the car, which is located between floors, should be moved. It is a feature of the new method to get the elevator cars back into the process of serving calls for service as quickly as possible, and thus, this portion of the program starts with step 180 which checks to see if there is a car call for, or a hall call from, a floor ahead of the elevator car in its last travel direction. Step 180 checks the call tables shown in FIG. 3, which are responsive to the car call signal $\overline{3Z}$, and to the up and down hall call signals $\overline{UPC}$ and $\overline{DNC}$, respectively. Step 180 can call a subroutine similar to that shown in FIG. 8. Car calls for floors ahead of the car are first examined. If there is a car call for a floor ahead, the floor number of the closest car call floor is stored. Hall calls are then examined. If the car is set to travel up, a pointer would be set to the lowest call in the up call table. When the floor address of a call equals or exceeds AVP, the call floor is compared with the stored car call floor, and step 196 would assign the car to the closest call floor by loading the floor address into its output word OP2, which is the assignment floor address for the car. If the car is set to travel down, the pointer would be set to the highest call in the down call table. When the floor address of a call equals or becomes less than the AVP, the call floor is compared with the car call floor previously stored for this direction, and step 196 would assign the car to the closest call floor by loading the floor address into OP2.

If step 180 fails to find any car or hall call associated with a floor ahead of the car in its last travel direction, step 198 complements the travel direction. Step 200 checks flag LZF to see if the car is in the leveling zone of the floor. If LZF is a logic one, the AVP assigned in step 174 is still valid, and step 200 proceeds to step 202. If step 200 finds LZF a logic zero, the AVP which was assigned in step 178 is not valid in the opposite travel direction. Thus, step 200 goes to step 204 to set AVP to the next floor in this new travel direction. Step 204 may call the subroutine shown in FIG. 8.

Steps 200 and 204 both advance to step 202 which checks for car and hall calls ahead in this new travel direction, using the modification of the subroutine shown in FIG. 8 described relative to step 180. If a car or hall call is found, step 206 assigns the car to the closest floor associated with a call, as described relative to step 196.

If step 202 does not find a car or hall call ahead in the complemented travel direction, the program advances to a portion of the program which moves a car to the floor of its AVP, such as by placing a dummy call for this floor. As illustrated, this program portion starts with a step 208 which complements the travel direction to return to its original travel direction. Step 210 checks flag LZR to see if the car is in the leveling zone of the floor of its AVP. If so, door and hall lantern assignments are prepared in step 212, and the program goes to step 156 to prepare and output the assignments, and the subprogram returns to the main program at 158. If step 210 does not find the elevator car to be in a leveling zone, step 210 goes to step 214 which sets AVP to the next floor in the last travel direction, and step 216 prepares a dummy call for the car by setting output word OP2 shown in FIG. 3 to the floor of the AVP. Step 216 then goes to step 212, and step 156 will now have the address of the cars AVP in output word OP2.

In summary, there has been disclosed new and improved methods of reinitiating an elevator system upon its return to service following an emergency stop. The new and improved methods specify a procedure which returns an elevator car to actual call answering service much faster than systems which reinitiate by returning the elevator car, or cars, to a reset floor.

We claim as our invention:

1. A method of reinitializing an elevator system in a building having a plurality of floors, including upper and lower terminal floors, following an occurrence which may result in an elevator car being stopped at a position other than level with a floor of the building, comprising the steps of:

determining if the elevator car is within a predetermined distance from a floor, setting the car position to the associated floor when it is found to be within said predetermined distance, setting the car position to the closest floor to the elevator car in a predetermined travel direction, when the elevator car is not within said predetermined distance, and moving the elevator car to a predetermined floor when it is not within said predetermined distance.

2. The method of claim 1 wherein each floor has a leveling zone, and the predetermined distance is the leveling zone.

3. The method of claim 1 wherein the step of determining if the elevator car is within a predetermined distance from a floor includes the step of physically detecting the presence of the elevator car within the predetermined distance from a terminal floor.

4. The method of claim 1 wherein the step of determining if the elevator car is within a predetermined distance from a floor includes the steps of maintaining a counter actuated by each predetermined increment of car movement, providing a floor address for each floor in terms of the count of the counter when the elevator car is located at the floor, and comparing the count on the counter with the floor addresses to determine if the elevator car is within the predetermined distance from a floor.

5. The method of claim 1 wherein the step of determining if the elevator car is within the predetermined distance from the floor includes the step of physically detecting the presence of the elevator car within the predetermined distance from a terminal floor, and if it is not within the predetermined distance of a terminal floor, determining if the elevator car is within the predetermined distance from an intermediate floor by the steps of maintaining a counter actuated by a predetermined increment of car movement, providing a floor address for each floor in terms of the count on the counter when the elevator car is located at the floor, and comparing the count on the counter with the floor addresses to determine if the elevator car is within the predetermined distance from a floor.

6. The method of claim 1 wherein the step of setting the car position to the closest floor to the car in the predetermined travel direction includes the step of determining the travel direction of the elevator car at the time of the occurrence, with the predetermined travel direction being this last travel direction of the elevator car.

7. The method of claim 6 wherein the step of moving the elevator car to a predetermined floor includes the step of determining if there is a registered call associated with a floor ahead of the elevator car in its last travel direction, and if so, the predetermined floor is the floor of the closest such call to the elevator car.

8. The method of claim 1 wherein the step of setting the car position to the closest floor to the car in a predetermined travel direction includes the steps of determining the travel direction of the elevator car at the time of the occurrence, with the predetermined travel direction being this last travel direction of the elevator car, determining if there is a registered call for elevator service associated with a floor ahead of the elevator car in its last travel direction, and if so, the predetermined floor, in the step of moving the elevator car, is the floor of the closest such call to the elevator car, complementing the last travel direction when the determining step finds no call associated with a floor ahead of the car in the last travel direction, setting the car position to the closest floor in the complemented travel direction, determining if there is a registered call for elevator service associated with a floor ahead of the elevator car in the complemented travel direction, and if so, the predetermined floor, in the step of moving the elevator car, is the floor of the closest such call to the elevator car.

9. The elevator system of claim 1 wherein the step of moving the elevator car to a predetermined floor includes the step of assigning the elevator car to travel to a floor associated with a registered call for elevator service, when at least one is registered, with the predetermined floor being the floor associated with the call.

10. The elevator system of claim 1 wherein the step of moving the elevator car to a predetermined floor includes the step of assigning the car to a dummy call for the predetermined floor, with the predetermined floor being the floor to which the car position was set by the prior setting step.

11. The elevator system of claim 1 wherein the step of moving the elevator car to a predetermined floor includes the step of assigning the elevator car to travel to a floor associated with an actual call for elevator service, when at least one is registered, with the predetermined floor being the floor associated with such a call, and placing a dummy call, in the absence of a registered call, with the predetermined floor of the dummy call being the car position used in the second setting step.

12. The method of claim 1 wherein the step of determining if the elevator car is within a predetermined distance from the floor includes the step of physically detecting the presence of the elevator car within the predetermined distance from a terminal floor, and if its presence is not so detected, the steps of maintaining a counter actuated by predetermined increments of car movement, providing a floor address for each floor in terms of the count on the counter when the elevator car is located at the floor, and determining if the counter has a valid count, with the predetermined floor to which the moving step moves the car being a predetermined terminal floor when the determining step finds the count not valid.

13. The method of claim 12 including the step of comparing the count of the counter with the floor addresses to determine if the elevator car is within the predetermined distance from an intermediate floor, when the validity step finds the count to be valid.

* * * * *